US005834569A

United States Patent [19]

Ramanath et al.

[11] Patent Number: 5,834,569

[45] Date of Patent: Nov. 10, 1998

[54] GRINDING WHEEL FOR FLAT GLASS BEVELING

[75] Inventors: Srinivasan Ramanath; William H. Williston, both of Holden; Sergej-Tomislav Buljan, Acton, all of Mass.

[73] Assignee: Norton Company, Worcester, Mass.

[21] Appl. No.: 922,917

[22] Filed: Sep. 3, 1997

Related U.S. Application Data

[63] Continuation of Ser. No. 407,221, Mar. 21, 1995, abandoned.

[51] Int. Cl.[6] ..... C08F 283/00

[52] U.S. Cl. ..... 525/480; 525/483; 525/485; 525/488

[58] Field of Search ..... 525/480, 483, 525/485, 488

[56] References Cited

U.S. PATENT DOCUMENTS

| | | | |
|---|---|---|---|
| 2,097,803 | 11/1937 | Sanford | 51/206 |
| 3,283,448 | 11/1966 | Thompson | 51/206 |
| 4,042,346 | 8/1977 | Sioui et al. | 51/298 |
| 4,314,827 | 2/1982 | Leitheiser et al. | 51/298 |
| 4,437,271 | 3/1984 | McAvoy | 51/400 |
| 4,518,397 | 5/1985 | Leitheiser et al. | 51/293 |
| 4,623,364 | 11/1986 | Cottringer et al. | 51/309 |
| 4,652,277 | 3/1987 | Makhlouf et al. | 51/309 |
| 4,744,802 | 5/1988 | Schwabel | 51/309 |
| 4,954,462 | 9/1990 | Wood et al. | 501/95 |
| 4,964,883 | 10/1990 | Morris et al. | 51/293 |
| 5,192,339 | 3/1993 | Hasegawa et al. | 51/309 |
| 5,215,551 | 6/1993 | Hatanaka et al. | 51/293 |
| 5,219,806 | 6/1993 | Wood | 501/127 |

FOREIGN PATENT DOCUMENTS

| | | | |
|---|---|---|---|
| 078896 | 5/1983 | European Pat. Off. | B24D 3/34 |
| 284173A3 | 1/1988 | European Pat. Off. | A61C 3/02 |
| 650807A1 | 9/1994 | European Pat. Off. | B24D 3/28 |
| 60099570 | 3/1985 | Japan | B24D 5/02 |
| 6039731 | 2/1994 | Japan | B24D 3/28 |
| 7032268A | 2/1995 | Japan | B24D 11/00 |
| 7241774A | 9/1995 | Japan | B24D 3/28 |
| 1010552 | 11/1965 | United Kingdom . | |
| 1259006 | 1/1972 | United Kingdom | B24D 3/34 |
| 2099012 | 12/1982 | United Kingdom | B24D 3/34 |

*Primary Examiner*—Duc Truong
*Attorney, Agent, or Firm*—Mary E. Porter

[57] ABSTRACT

A composite, polymer bonded abrasive wheel is disclosed for grinding operations and especially for use with multiple station, glass beveling machines. The abrasive wheel breaks in quickly and delivers consistent performance with little or no dressing needed over the entire life of the wheel. In one aspect, the novel abrasive wheel includes a concentrically mounted, annular abrasive rim on a cup shaped hub. The rim can contain an abrasive such as diamond or cubic boron nitride which is embedded in a bonding composition that includes amino aldehyde and phenolic thermoset polymers, a plasticizer, and optionally filler. The hub includes a crosslinkable, strong and rigid, engineering polymer, preferably melamine phenolic thermoset polymer, mixed with spodumene in amount effective to make the coefficient of thermal expansion of the hub match that of the rim. The wheel can be made by simultaneously hot pressing rim and hub preforms and without an additional baking step. Optionally the rim and hub can be colored to identify the characteristics of the abrasive, and to help determine that the grinding surface has worn down to the hub.

9 Claims, No Drawings

GRINDING WHEEL FOR FLAT GLASS BEVELING

This application is a continuation of application Ser No. 08/407,221, filed Mar. 21, 1995, now abandoned.

FIELD OF THE INVENTION

This invention relates to abrasive tools for grinding. More specifically, the invention relates to polymer bonded abrasive wheels primarily for beveling flat glass.

BACKGROUND AND SUMMARY OF THE INVENTION

Machines such as those made by the Italian manufacturer Bavone are used extensively to bevel edges of flat glass articles. These machines utilize multiple abrasive wheels in tandem. A first group of wheels performs coarse grinding and generally employs metal bonded, relatively large particle size abrasives. Intermediate and final groups of wheels use finer particle size abrasives to perform preliminary and finish polishing, respectively.

The present invention largely concerns the intermediate group, which typically comprises about four wheels. These wheels usually are a composite construction having an abrasive rim concentrically mounted on a cup shaped hub occasionally called a core. The particulate abrasive, such as diamond and cubic boron nitride, is normally dispersed throughout the rim in a polymer based, bonding composition. The hub also can be a polymer based composition.

Formaldehyde based, thermoset polymers, such as phenol formaldehyde polymers, have good adhesive, dimensional stability and high temperature resistance properties, and thus, are often used for bonding abrasives in grinding tools. These polymers can bond so strongly that the abrasive particles become dull and the grinding surface loads with material being ground faster than the polymer wears away. When this happens, grinding effectively stops until renewed, usually by pressing a dressing substance against the grinding surface to expose fresh abrasive particles. Dressing the grinding surface removes the machine from production and is a significant drawback of such bonding compositions. Because dressing the wheels of Bavone type machines is notoriously difficult, the need for dressing substantially reduces productivity.

Several methods are available to attenuate the strength of the bonding composition. The useful life of the wheel can be shortened, however, if bond strength is made so weak that abrasive particles release from the rim too quickly.

One method of reducing the bond strength of formaldehyde based polymers to desired levels is to adjust the amount of crosslinking agent used to control the extent to which the polymer cures. Another method is to introduce various types and proportions of comonomers, such as melamine and urea. Also, bond strength can be adjusted by diluting the polymer with inorganic fillers, such as metal oxides and graphite. These methods generally depend on the polymer formulations provided by the polymer supplier, and thus, are difficult for the wheel manufacturer to control.

According to the present invention, the above described methods are supplemented by adding plasticizer for the polymers to the bonding composition. This technique permits the control of bond strength to the degree that the novel wheel needs little or no dressing over its entire life. One aspect of the novel wheel also features a hub of engineering polymer and inorganic material combined in such proportions that the coefficient of thermal expansion of the hub effectively matches that of the abrasive rim. This provides a uniform stress distribution in the rim which also helps to avoid the need for dressing.

The novel abrasive wheels are also efficient to make. Processes for manufacturing composite abrasive wheels usually involve the steps of preparing the abrasive in a bonding composition; separately preparing a hub composition; assembling these compositions appropriately within a mold; and thermally processing the mold contents under pressure, to cure the polymers. The wheel traditionally is subjected to an additional baking step in which the wheel remains heated for a substantial time before cooling. This step cures the polymer more completely, which strengthens the bond. However, the baking step significantly slows production and consumes energy. The novel abrasive wheel can be made without an extra baling step, and thus, is less wasteful of energy and more economical to produce than a conventional wheel.

A problem associated with multi-wheel grinding machines has been that wheels with different particle size abrasives previously have been made to appear physically identical. This could easily lead a set up mechanic to install wheels of incorrect abrasive particle size. Wheels of a Bavone type machine also are hard to inspect while grinding and it is difficult to determine whether the abrasive rim has worn out. Therefore, it is an object of the present invention to provide an abrasive wheel for use in a multi-wheel machine, which is simple to distinguish as to abrasive characteristics. The rim, hub or both of each novel abrasive wheel can be colored according to a predetermined color coding scheme to identify particle size, shape and type of abrasive. This permits simple verification that wheels are installed in the appropriate sequence. It is an additional feature of this invention that contrasting colors can be chosen for the hub and rim of each wheel. This provides the advantage that an operator can easily detect by visual inspection from a distance and while the machine runs, whether the abrasive has worn out.

Universal Superabrasives, Incorporated of Chicago, Ill. offers a composite abrasive wheel for beveling glass. Based on analysis of a sample wheel, it is believed that the Universal Superabrasives wheel includes an abrasive rim of diamond in a bond medium containing melamine urea formaldehyde polymer, cerium oxide and graphite. The hub of the Universal Superabrasives wheel is believed to comprise a melamine formaldehyde polymer and other material. Analysis of the sample did not reveal the presence of a plasticizer. Plasticizer now has been discovered to be among the materials which contribute to the successful manufacture and use of such composite abrasive wheels as the Universal Superabrasives type of wheel. Thus, it is possible that plasticizer might be present in the sample, but was undetectable due to limitations of the analytical methods used. Therefore, it is uncertain whether the Universal Superabrasives bond medium includes a plasticizer. The analytical methods were capable of detecting the presence of phenol formaldehyde polymer and spodumene and neither of these materials was found in the sample.

It is desirable to have a composite abrasive wheel, especially for beveling glass using a multi-wheel grinding machine, which does not need dressing during the life of the wheel and which can be made without the need for an additional baking step.

Accordingly, there is provided an abrasive wheel comprising:

an abrasive rim including:

(a) an abrasive selected from the group consisting of diamond, cubic boron nitride, silicon carbide, garnet, boron oxide, aluminum oxide, micro-crystalline aluminum oxide; and mixtures thereof; and (b) an effective amount of a bonding composition to bond the abrasive in the abrasive rim, the bonding composition comprising:

(1) an amino aldehyde polymer;

(2) a phenolic polymer; and (3) a plasticizer.

There is also provided a bonding composition for an abrasive in a grinding tool comprising amino aldehyde polymer, phenolic polymer and plasticizer. There is further provided a method of grinding articles by using abrasive wheels described above. Still further, there is provided a set of polymer bonded abrasive wheels for a multiple wheel grinding machine, said set comprising a plurality of abrasive wheels wherein each wheel includes an abrasive rim supported by a hub; wherein at least one of the abrasive rim and the hub is a color which distinctively identifies the abrasive in accordance with a predetermined color coding scheme.

DETAILED DESCRIPTION

The abrasive rim comprises an abrasive in the form of particles uniformly which are dispersed within a bonding composition. Preferably the abrasive particles comprise about 1–50 volume %, and more preferably, 2–40 volume % of the rim. The bonding composition is present in a complementary amount, preferably about 50–99 volume %, and more preferably, about 60–98 volume %. A particularly preferred rim is about 95 volume % bonding composition and about 5 volume % diamond abrasive. Particulate abrasive materials which are well known in the art for this purpose, such as, diamond, cubic boron nitride, silicon carbide, aluminum oxide, garnet, and boron oxide, can be used. Diamond, such as friable diamond type RVG from General Electric, and cubic boron nitride are preferred for glass beveling.

Micro-crystalline alumina is another abrasive that is suitable for use in the present invention. While the micro-crystalline alumina can be the sole abrasive, it is preferably present in a blend with at least one other, usually harder, abrasive, such as diamond, cubic boron nitride, silicon carbide, and the like. "Micro-crystalline alumina" means sintered sol-gel alumina in which the crystals of alpha alumina are of a basically uniform size which is generally smaller than about 10 μm, and more preferably less than about 5 μm, and most preferably less than about 1 μm in diameter. Crystals are areas of essentially uniform crystallographic orientation separated from contiguous crystals by high angle grain boundaries.

Sol-gel alumina abrasives are conventionally produced by drying a sol or gel of an alpha alumina precursor which is usually but not essentially, boehmite; forming the dried gel into particles of the desired size and shape; then firing the pieces to a temperature sufficiently high to convert them to the alpha alumina form. Simple sol-gel processes are described, for example, in U.S. Pat. Nos. 4,314,827 and 4,518,397; and British Patent Application 2,099,012, the disclosures of which are incorporated herein by reference.

In a particularly desirable form of sol-gel process, the alpha alumina precursor is "seeded" with a material having the same crystal structure as, and lattice parameters as close as possible to, those of alpha alumina itself The "seed" is added in as finely divided form as possible and is dispersed uniformly throughout the sol or gel. It can be added ab initio or it can be formed in situ. The function of the seed is to cause the transformation to the alpha form to occur uniformly throughout the precursor at a much lower temperature than is needed in the absence of the seed. This process produces a crystalline structure in which the individual crystals of alpha alumina are very uniform in size and are essentially all sub-micron in diameter. Suitable seeds include alpha alumina itself but also other compounds such as alpha ferric oxide, chromium suboxide, nickel titanate and a plurality of other compounds that have lattice parameters sufficiently similar to those of alpha alumina to be effective to cause the generation of alpha alumina from a precursor at a temperature below that at which the conversion normally occurs in the absence of such seed. Examples of such seeded sol-gel processes are described in U.S. Pat. Nos. 4,623,364; 4,744,802; 4,954,462; 4,964,883; 5,192,339; 5,215,551; 5,219,806, the disclosures of which are incorporated herein by reference, and many others.

The abrasive characteristics, such as type of material, particle size, hardness and sharpness, can be selected to suit the intended grinding operation. For example, for a multi-wheel glass beveling machine, the nominal particle size can be up to about 150 μm for the intermediate group of wheels and generally larger for the first group of coarse grinding wheels. Typically, the nominal abrasive particle size of each intermediate group wheel differs from that of adjacent wheels, for example by at least about 10 μm, although particle size distributions of adjacent wheels can overlap. An example sequence of intermediate group abrasive wheels can have nominal abrasive particle sizes of about 75, 65, 50 and 35 μm, respectively. It sometimes can be desirable to include multiple wheels having the same nominal abrasive particle size within a group.

The bonding composition includes a crosslinkable, amino aldehyde polymer, such as aniline formaldehyde polymer, urea formaldehyde polymer, urea aldehyde polymer, melamine formaldehyde polymer and melamine urea formaldehyde polymer. The amino aldehyde polymer is generally thermally crosslinkable when mixed with other components of the abrasive rim and is cured during wheel manufacture. Urea formaldehyde polymer, melamine formaldehyde polymer and melamine urea formaldehyde polymer (hereinafter, "M/U/F" polymer) are preferred. M/U/F is a polymeric reaction product of formaldehyde and 0:100–100:0, preferably about 50:50–90:10, and more preferably about 75:25 melamine:urea, based on parts by volume. Increasing the proportion of urea relative to melamine tends to weaken the bonding composition which can cause the rim to wear more rapidly. A preferred M/U/F polymer is available from BTL Specialty Resins Corp. under the tradename MUF-184. BTL product MUF-182 is believed to have a similar composition and should also function well. The bonding composition can comprise about 30 to about 80, preferably about 45 to about 65, and more preferably about 55 volume % of amino aldehyde polymer.

The bonding composition also includes about 5 to about 25, preferably 10 to 20, and more preferably about 15 volume % of a phenol formaldehyde polymer, (hereinafter "phenolic" polymer). The phenolic polymer is a chemically crosslinkable reaction product of formaldehyde and a phenol compound such as phenol, resorcinol and m-cresol. Phenol is preferred. During wheel manufacture, a crosslinking agent is normally added to the components of the bonding composition to crosslink the phenolic polymer. A common crosslinking agent is hexamethylenetetramine. The phenolic polymer appears to act as a toughening agent for the amino aldehyde polymer, and thus, makes the rim less brittle and less subject to cracking in operation. A preferred phenolic polymer is available from Plastics Engineering Co. under the tradename Varcum 29-345 Resin, which contains 6 volume % hexamethylenetetramine.

A filler component can be present in the bonding composition. The filler component can be a single chemical entity, but preferably it contains multiple constituents. Although hardness of the filler is not critical, for beveling glass and other applications in which scratching the work piece is undesirable, it is preferable that the filler should be at most as hard as the material to be ground. The filler component is generally incorporated to dilute the polymer components for wear resistance, to lubricate, and to control byproducts of the crosslinking process. Well known wear resistant filler components such as oxides, nitrides and carbides can be used. Representative solid lubricant filler components include cerium oxide, graphite, hexagonal boron nitride, polytetrafluoroethylene, molybdenum disulfide and molybdenum disilicide, for example. Calcium oxide (quicklime) is sometimes included as a moisture absorbing agent, although any of the chemicals known in the art for controlling reaction byproducts of formaldehyde polymer curing can be used. The moisture absorbing agent is counted among the constituents of the filler component for the purpose of this disclosure. In practice, however, it is often incorporated in the polymer components, especially the phenolic polymer. Preferably, the bonding composition contains about 2–70 volume % filler. A particularly preferred multi-constituent filler includes about 10 volume % graphite, about 10 volume % cerium oxide and about 0.1–2 volume % calcium oxide, where these volume percentages are based on the total volume of the bonding composition.

In accordance with the present invention, the bonding composition further includes about 0.5 to about 30, preferably about 1 to about 20, and more preferably about 8 to about 12 volume % of a plasticizer for the amino aldehyde polymer/phenolic polymer blend. The plasticizer makes the polymers more flexible and thus affects bond strength. Bond strength can be optimized by adjusting the concentration of plasticizer in the bonding composition. Plasticizers suitable for use in this invention should be extraction and bleed resistant solids or liquids of low volatility that are compatible with amino aldehyde and phenolic polymers, i.e., the plasticizer solubility parameter is substantially similar to those of the polymers. Representative plasticizers include chlorinated hydrocarbons, such as chlorinated paraffin plasticizers, and sulfonic acid derivatives, such as benzenemethylsulfonamide; o-, and p-toluenesulfonamide; and o-, and p-tolueneethylsulfonamide. Toluenesulfonamide, which is available from Akzo Chemicals Inc. under the tradename Keijenflex™ is preferred.

Optionally, the bonding composition includes means, such as a pigment, in an amount effective to provide a distinctive, uniform color to the rim, for purposes described below.

The hub of the wheel according to this invention is a mixture of a generally crosslinkable, strong and rigid, engineering polymer; an inorganic material for modifying the coefficient of thermal expansion, (occasionally hereinafter, "CTE") of the hub; and an optional coloring means, such as a pigment. Representative engineering polymers include formaldehyde polymers; thermoset polyurethanes; unsaturated polyesters; epoxy resins; furan resin; polyamides; polyimides; polyamide imides; polyureas; acrylic polymers; polycarbonates; polyolefins, such as polyethylene and polypropylene; polypropylene oxide; polyphenylene sulfide; styrene maleic anhydride polymers; and mixtures thereof. Formaldehyde polymers, which can provide integrity by bonding across the rim-hub interface due to the chemical similarity to the rim polymers, are preferred. Formaldehyde polymers include, for example, aniline formaldehyde polymer, urea formaldehyde polymer, melamine formaldehyde polymer, melamine urea formaldehyde polymer, phenolic polymer and melamine phenolic polymer. Melamine phenolic polymer is particularly preferred. A melamine phenolic polymer is available from Plastics Engineering Company of Sheboygan, Wis., under the tradename Plenco™ 00732, a molding compound which is believed to contain cellulosic filler.

Thermoset polymer based abrasive wheels are normally made by molding at reaction temperature and pressure. Conventional wheels frequently develop cracks after molding. It has been discovered that reduced frequency of crack formation and other benefits result by causing the rim to be in a state of stress from about neutral to slight compression. If the stresses are in tension, the rim tends to crack. Similarly, if the rim stresses are in excessive compression, they place the hub stresses in tension, which tends to produce cracks in the hub. A preferred method of assuring that rim stresses are about neutral to slightly compressive, is to cause CTE's of the hub and rim to match. The term "match" means that the CTE's are substantially similar, and not necessarily exactly identical. When the CTE's are matched according to this invention, the stress distribution across the depth of the rim also is more uniform than would result otherwise. This uniform stress distribution contributes to more consistent wheel performance. That is, the abrasive rim tends to wear uniformly, and power consumption during grinding generally remains steady over the entire life of the wheel.

The rim generally will be in compression when the hub CTE is higher than the rim CTE, and in tension when the hub CTE is lower than that of the rim. The desired stresses in the rim arise when the CTE of the hub is about 90% to about 110%, preferably about 100% to about 110%, and most preferably about 100 to about 105% of the CTE of the abrasive rim. The coefficients of thermal expansion can be determined by direct measurement or by calculation in accordance with the method of P. S. Turner described in U.S. Pat. No. 4,652,277, which is incorporated herein by reference.

The inorganic material for modifying the coefficient of thermal expansion of the hub should have a CTE that is lower than that of the rim. This will assure that the inorganic material can reduce the CTE of the hub to match that of the rim. It is also generally desirable that the inorganic material be sufficiently nonabrasive to avoid scratching the work piece if the wheel is not replaced immediately after the abrasive rim wears completely away. Representative CTE-modifying materials include fused silica, $NaZr_2P_3O_{12}$, $BaZr_4P_6O_{24}$, magnesium aluminum silicate, mullite, aluminum silicate and spodumene. A preferred inorganic material for modifying the CTE is spodumene ($LiAlSi_2O_6$), which is used in the form of particles small enough to pass through a U.S. No. 200 sieve. The CTE of the hub generally decreases in proportion to the amount of spodumene incorporated. Spodumene should be added to the hub composition in an amount effective to match the hub and rim coefficients of thermal expansion. Preferably, spodumene should be about 5 to about 40, and more preferably about 11 volume % of the spodumene/engineering polymer mixture.

Optionally, the hub includes a means, such as a pigment in an effective amount, for providing a distinctive, uniform color. The color of the hub is selected according to a scheme predetermined by the wheel maker to contrast with the color of the rim. When the abrasive rim completely wears away, the exposed hub color reveals to the operator that the wheel should be replaced. The operator can observe the rim condition by visual inspection from a distance and without the need to shut down the machine. The color coding scheme also can be used to identify the type, e.g., nature, particle size and sharpness of the abrasive. Thus, the present invention provides for a product line of composite abrasive wheels which are color coded to identify the type of abrasive of each wheel in the line and to help determine when the abrasive becomes worn out.

"Painted on" coloring, such as can be achieved by dip, spray or brush painting the exterior surface of the finished wheels will serve to identify the characteristics of a given wheel. Coloring according to the present invention, however, provides color throughout the body of the wheel such that the grinding surface exhibits color regardless of the extent of wear.

Methods of producing the novel abrasive wheels are similar to those well known in the art. Generally, separate uniform mixtures of rim and hub materials are prepared. Polymer materials are incorporated in the uncured state together with any crosslinking agents. Often, the polymer materials are obtained as precompounds containing crosslinking agents, pigments and part or all of the filler. The mixtures are placed in a mold, heated and pressurized to crosslink the polymers. The molded wheels can be cooled directly to ambient temperature for the final stages of production, e.g. cleaning, inspection and packaging.

While discussed in context of multi-wheel glass beveling machines, the bonding composition and abrasive wheel of this invention also can be used in other types of grinding operations, such as honing, sharpening and polishing. Generally, the cutting surface of a grinding tool of the novel abrasive and bonding composition can be operated at about 20–50 m/s to cut a width of about 12–40 mm of work piece to a depth of about 0.0025–0.10 mm per pass. Work piece line speed can be maintained at about 1.5–7 m/min. Optimum operating conditions can vary within these ranges, depending on the nature of the material being ground and the relationship between conditions. For example, for a given work piece, the maximum line speed can depend on the width and depth of cut. However, optimum operating conditions can be determined without undue experimentation by one of ordinary skill in the art.

This invention is now illustrated by examples of certain representative embodiments thereof, wherein all units of weight and measure not originally obtained in SI units have been converted to SI units.

EXAMPLES

Example 1

Phenol formaldehyde polymer was screened through a U.S. No. 200 sieve and the fines were combined with the other bonding composition components of Table I. The mixture was screened through a U.S. No. 120 sieve. Nominally 80 $\mu$m, friable diamond abrasive particles were added to make a mixture of 5 volume % diamond/95 volume % bonding composition. The mixture was blended for five minutes in a Turbula™ mixer to obtain a uniform rim composition. Components of Table II were mixed to obtain a uniform hub composition.

The hub composition was placed in the hub section of a mold for a composite abrasive wheel, and compacted. The rim composition was placed in the rim section of the mold, and the mold was then pressurized to 4.23 kg/mm$^2$ (3 tons per sq. inch) and heated to 150°–160° C. for 30 minutes. The abrasive wheel was removed from the mold, allowed to cool to ambient temperature, cleaned and inspected. The hub section was cup-shaped, with a 34.5 mm height, 10.2 cm (4 inches) outer diameter at the base, 15.0 cm (5.9 inches) outer diameter at the rim, and 22 mm spindle hole diameter. The rim was a ring of 15.0 cm outer diameter and a rectangular cross section of 9.5 mm (⅜ inch) width and 9.5 mm depth.

No pigment was added to the bonding composition, and consequently, the rim exhibited a deep gray color. The melamine phenolic molding compound used in the hub included a predispersed pigment which gave the hub a uniform color in contrast with the rim.

TABLE I

| Abrasive Bonding Composition | Volume %‡ |
|---|---|
| 75 vol. % Melamine/25 vol. % urea M/U/F polymer | 55 |
| Varcum 29-345 Resin phenol formaldehyde polymer including 6 vol. % hexamethylenetetramine and 4.3 vol. % calcium oxide. | 15 |
| Cerium oxide | 10 |
| Graphite | 10 |
| Ketjenflex ™ toluene Sulfonamide | 10 |

‡Exclusive of diamond

TABLE II

| Hub Composition | Volume % |
|---|---|
| Plenco 00732 Melamine phenolic molding compound | 89 |
| Spodumene | 11 |

Examples 2–4

The procedure of Example 1 was repeated using different diamond abrasive particle sizes and differently pigmented, hub composition molding compounds to produce abrasive wheels with differently colored hubs. Each hub color contrasted with the deep gray rims. The nominal diamond abrasive particle sizes were as shown in Table III.

Example 5

The abrasive wheels of Examples 1–4 were installed at station nos. 4–7, respectively, of a 10 station, Bavone glass beveling machine. Flat glass was ground on this machine to produce 2654.6 m of a 25 mm wide bevel at up to 2.85 m/minute. The depth of rim worn away during operation was measured as shown in Table III. Based on the original rim depth, projected lifetime beveling capacity of the rim was calculated, as shown in the table. The grinding lasted for about 24 hours, during which time no wheel dressing was required. All glass product passed quality control tests for scratches, dullness and other beveling irregularities, indicating that grinding was consistent throughout the test. By comparison, a similarly configured machine equipped with wheels from Universal Superabrasives lasted for about 25,400 m, and at a lower production rate between 1.9–2.1 m/minute. Beveling productivity of the machine with the novel wheels was increased to 889 m per shift. The conventionally equipped machine productivity was 635 m per shift.

TABLE III

| | Nominal Particle Size μm | Rim Wear mm | Projected Rim Capacity m |
|---|---|---|---|
| Ex. 1 | 80 | 0.79 | 31,500 |
| Ex. 2 | 50 | 0.94 | 26,390 |
| Ex. 3 | 40 | 1.12 | 22,190 |
| Ex. 4 | <35 | 0.81 | 30,510 |

Example 6

A new set of four wheels made as in Examples 1–4 was mounted on the intermediate stations of a Bavone beveling machine. The machine was able to make 12.7 mm (½ inch) wide bevels at 6.1 m/min. In comparison, the same beveling machine equipped with wheels from Universal Superabrasives was only able to run at 5.1 m/min.

What is claimed is:

1. A bonding composition for an abrasive grinding tool, comprising:

(1) an amino aldehyde polymer;

(2) a phenolic polymer; and (3) a sulfonic acid derivative plasticizer;

wherein an effective amount of plasticizer is present to render the bonding composition sufficiently flexible and strong to grind glass with superabrasive grain.

2. A bonding composition of claim 1 wherein the amino aldehyde polymer is selected from the group consisting of urea formaldehyde polymer, melamine formaldehyde polymer and melamine urea formaldehyde polymer.

3. The bonding composition of claim 2 wherein the amino aldehyde polymer is melamine urea formaldehyde polymer and the volume ratio of melamine:urea is about 50:50 to about 90:10.

4. The bonding composition of claim 1 wherein the plasticizer is toluenesulfonamide.

5. A bonding composition for an abrasive grinding tool, comprising:

(1) about 30 to about 80 volume % melamine urea formaldehyde polymer;

(2) about 5 to about 25 volume % phenolic polymer; and (3) about 0.5 to about 30 volume % toluenesulfonamide.

6. A bonding composition of claim 5 further comprising a complementary amount to total 100 volume % of filler, including:

(i) about 5 to about 40 volume % graphite;

(ii) about 5 to about 35 volume % cerium oxide; and (iii) about 0.1 to about 2 volume % calcium oxide;

wherein the volume percentages of (i), (ii) and (iii) are based on the total of components (1)–(3) and (i)–(iii).

7. A bonding composition for a superabrasive tool used to grind glass, comprising:

(1) an amino aldehyde polymer;

(2) a phenolic polymer; and (3) 8 to 12 volume % of a plasticizer selected from the group consisting of sulfonic acid derivatives and chlorinated hydrocarbons.

8. The bonding composition of claim 7, wherein the plasticizer and polymers are characterized by substantially similar solubility parameters.

9. The bonding composition of claim 7, comprising:

(1) 30 to 80 volume % of the amino aldehyde polymer;

(2) 5 to 25 volume % of the phenolic polymer; and (3) 8 to 12 volume % of the plasticizer.

* * * * *